US005123956A

United States Patent [19]

Fernandez et al.

[11] Patent Number: 5,123,956

[45] Date of Patent: Jun. 23, 1992

[54] PROCESS FOR TREATING ORE HAVING RECOVERABLE GOLD VALUES AND INCLUDING ARSENIC-, CARBON- AND SULFUR-CONTAINING COMPONENTS BY ROASTING IN AN OXYGEN-ENRICHED GASEOUS ATMOSPHERE

[75] Inventors: Rene R. Fernandez; K. M. Le Vier, both of Salt Lake City, Utah; Anthony L. Hannaford, Littleton, Colo.; Gopalan Ramadorai, Tuscon, Ariz.

[73] Assignees: Newmont Mining Corporation; Newmont Gold Company, Denver, Colo.

[21] Appl. No.: 684,649

[22] Filed: Apr. 12, 1991

[51] Int. Cl.[5] ..... C22B 11/00

[52] U.S. Cl. ..... 75/423

[58] Field of Search ..... 75/423

[56] References Cited

U.S. PATENT DOCUMENTS

| | | | |
|---|---|---|---|
| 2,878,102 | 3/1959 | Sternfels | 423/26 |
| 3,172,755 | 3/1965 | Vian-Ortuno | 423/148 |
| 4,731,114 | 3/1988 | Ramadorai | 423/29 |
| 4,919,715 | 4/1990 | Smith | 75/423 |

*Primary Examiner*—Peter D. Rosenberg
*Attorney, Agent, or Firm*—Fred A. Keire

[57] ABSTRACT

Recovery of a precious metal value from refractory carbonaceous and sulfidic ores, concentrates or tailings which also include arsenic-containing components is improved by roasting the ore or ore concentrate in an oxygen-enriched gaseous atmosphere having an initial oxygen content from about 25 percent (by volume) to about 65 percent (by volume) while maintaining a reaction temperature of less than about 600 degrees Celsius during the roasting and while maintaining a minimum amount of iron to react with arsenic and for forming ferricarsenate; thereafter recovering a thus-roasted ore as calcine, whereby the calcine is amenable to recovery of precious metal values in it; gold ores are preferred candidate ores.

45 Claims, 7 Drawing Sheets

PROCESS FOR TREATING ORE HAVING RECOVERABLE GOLD VALUES AND INCLUDING ARSENIC-, CARBON- AND SULFUR-CONTAINING COMPONENTS BY ROASTING IN AN OXYGEN-ENRICHED GASEOUS ATMOSPHERE

BACKGROUND OF THE INVENTION

1. Technical Field of the Invention

This invention relates to recovering precious metal values from refractory ores, ore concentrates, or ore tailings which include arsenic-, carbon- and sulfur-containing components and which are refractory to the recovery of those precious metal values.

2. Background Art

Precious metals, such as gold, occur naturally in ores in different forms. Unfortunately, precious metal ores also frequently contain other materials which interfere with the recovery of these precious metal values, rendering these ores refractory to precious metal recovery. Furthermore, the precious metal content may be at a relatively low level. This low level content compounds the effect of the refractory nature of these ores.

The following patents are illustrative of attempts to deal with refractory components in precious metals recovery as well as efforts in distinctly different fields.

U.S. Pat. No. 360,904 to Elizabeth B. Parnell relates to roasting gold or silver bearing ores using a double roasting schedule with the first roasting at 1100 to 1300 degrees Fahrenheit and the second roasting at 1200 to 1600 degrees Fahrenheit (the time occupied in the second roasting can be reduced by supplying oxygen along with the air.)

U.S. Pat. No. 921,645 to J.E. Greenwalt discloses the roasting of ore by heating the ore on a porous granular bed through which air is forced from below.

U.S. Pat. No. 1,075,011 to N.C. Christensen, Jr. discloses a process for treating ore by means of a roasting oven which, by regulation of the fuel supply, may be either oxidizing, reducing, or neutral.

U.S. Pat. No. 2,056,564 to Bernard M. Carter discloses suspension roasting of finely divided sulfide ores. Roasting is in air or oxygen in which the temperature of the mixture entering the roasting chamber is controlled and to a corresponding degree the temperatures within the roasting chamber are thus controlled in an effort to prevent the formation of accretions on the walls of the apparatus.

U.S. Pat. No. 2,209,331 to Ture Robert Haglund discloses a process for the production of sulfur from the roasting of sulfide material in oxygen or air enriched with oxygen so that as soon as the free oxygen has been consumed in the formation of $SO_2$, the iron sulfide reacts with the sulfur dioxide forming free sulfur and iron oxides.

U.S. Pat. No. 2,536,952 to Kenneth D. McCean relates to roasting mineral sulfides in gaseous suspension.

U.S. Pat. No. 2,596,580 to James B. McKay et al. and U.S. Pat. No. 2,650, 169 to Donald T. Tarr, Jr. et al., relates to roasting gold-bearing ores which contain commercially significant amounts of gold in association with the mineral arsenopyrite. The patent describes the importance of closely regulating the availability of oxygen in order to provide enough oxygen so that volatile compounds of arsenic are formed while the formation of nonvolatile arsenic compounds is minimized.

U.S. Pat. No. 2,867,529 to Frank A. Forward relates to treatment of refractory ores and concentrates which contain at least one precious metal, sulfur and at least one arsenic, antimony or lead compound by roasting in a non-oxidizing atmosphere at a temperature above 900 degrees Fahrenheit, but less than the fusion temperature of the material being roasted.

U.S. Pat. No. 2,927,017 to Orrin F. Marvin relates to a method for refining metals, including precious metals, from complex ores which contain two or more metal values in chemical union or in such physical union as to prevent normal mechanical separation of the values. The method uses multiple roasting steps.

U.S. Pat. No. 2,993,778 to Adolf Johannsen et al. relates to roasting a sulfur mineral with its objects being-the production of sulfur dioxide, increasing the completeness of roasting, the production of sulfur dioxide and the production of metal oxides.

U.S. Pat. No. 3,172,755 to Angel Vian-Ortuno et al. relates to a process for treating pyrite ores bearing arsenic by subjecting the arsenic-containing pyrite ore to partial oxidation so as to oxidize only the labile sulfur of the arsenic-containing pyrite and subsequently heating the pyrite ore in a nonoxidizing gas to separate the arsenic from the ore and to form a residual ore free of arsenic.

U.S. Pat. No. 4,731,114 Gopalan Ramadorai et al. relates to a process for the recovery of precious metals from low-grade carbonaceous sulfide ores using partial roasting of the ores following by aqueous oxidation in an autoclave.

U.S. Pat. No. 4,919,715 relates to the use of pure oxygen in roasting of refractory gold-bearing ores at temperatures between about 1000° F. (537.8° C.) and about 1200° F. (648.9° C.). It fails to address the problem of arsenic volatilization or of optimizing gold recovery from refractory sulfidic, carbonaceous or separation of cyanide consuming components before recovery of gold from the ore. The disclosed method requires two stage roasting and the use of substantially pure oxygen (substantially pure oxygen being defined as at least about 80% by weight.)

None of these patents teaches o suggests roasting refractory ores, ore concentrates or ore tailings of the type described herein in an oxygen-enriched gaseous environment as described here in order to minimize and/or eliminate arsenic volatilization, facilitate arsenic conversion to an insoluble, environmentally acceptable form while reducing the effects of carbon- and sulfur-containing components on precious metal recovery. The present invention achieves these results in a simpler more efficient manner with outstanding gold recovery results while minimizing leachant cyanide consumption and conserving heat given-off in the roasting process.

BRIEF DESCRIPTION OF THE INVENTION

Figure 1:
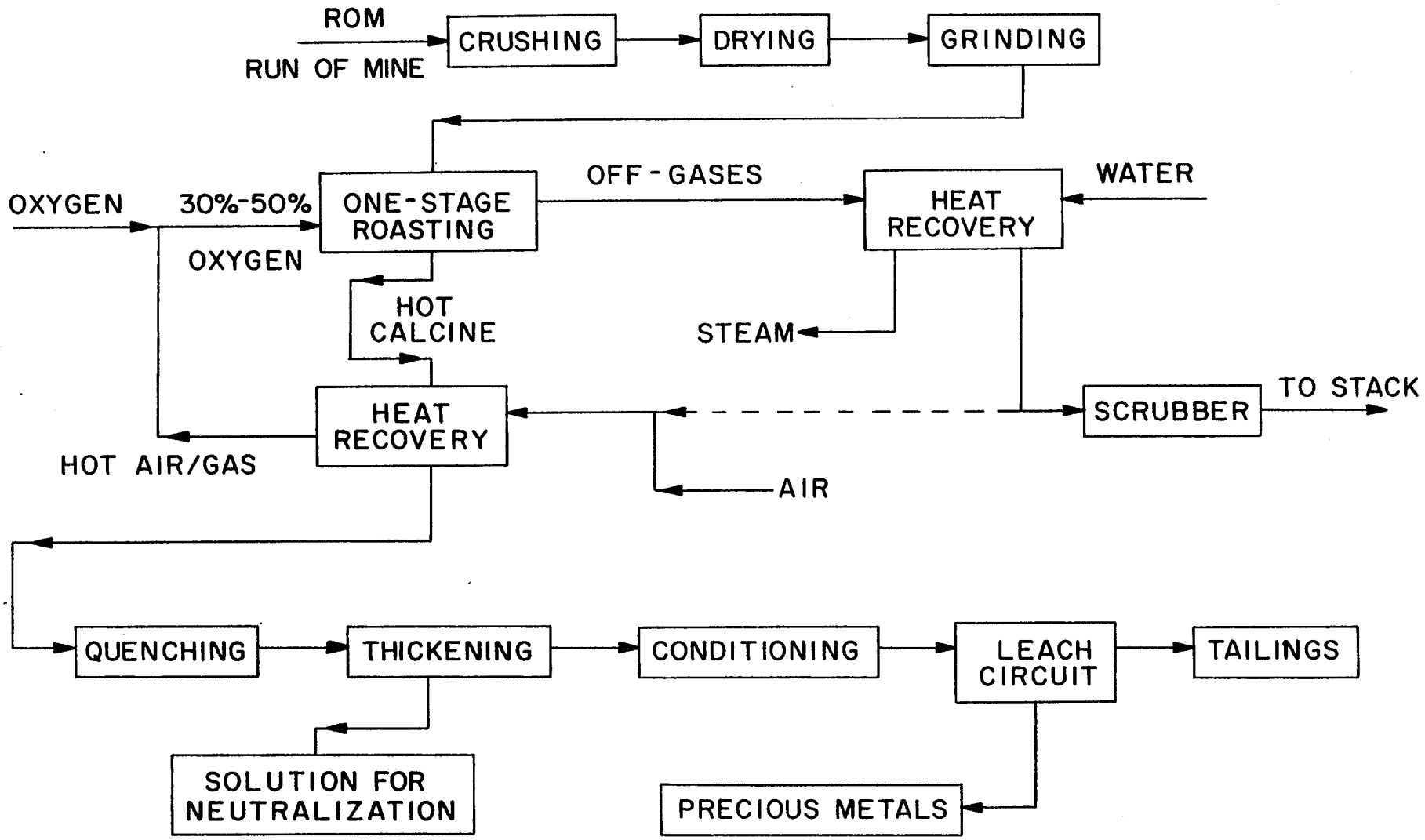
FIG. 1 is a flow diagram of the process of the present invention.

In accordance with the present invention precious metal values may be recoverable from ore, ore concentrates or tailings which have arsenic- carbon- and sulfur-containing components by 1) comminuting the material to a desired particle size;
2) roasting the comminuted material under the conditions set forth herein which oxidizes, or burns off, the carbon and sulfur values and provides a calcined product amenable to efficient gold recovery; while
3) sequestering in and/or converting arsenic to an insoluble form while roasting the comminuted material, and
4) leaching with increased efficiency the precious metal values from the roasted materials.

Other advantages of the present process will be further explained such as improved heat recovery, fast reaction rates, lowered emission of gases such as fluorine, etc.

Refractory ores which include carbon-and sulfur-containing components, such as organic and inorganic carbonaceous materials and sulfidic minerals, respectively, pose a problem in the economical, commercial recovery of precious metals, such as gold, because the efficiency and completion of recovery is dependent on the content of those carbon- and sulfur-containing components. The recovery yield of precious metal values in refractory ores can be increased by oxidizing carbon- and sulfur-containing components. The efficient oxidation of carbon is especially important because residual carbon in the roasted ore, or calcine, reduces precious metal recovery during leaching by "preg robbing" because it takes up or "robs" leachant solubilized gold.

However, refractory ores which further include arsenic-containing components pose a more complex problem. This arsenic content, while amenable to oxidation, poses a problem in that the arsenic component or an intermediate product of roasting may volatilize at roasting temperatures, thereby requiring supplemental precautionary processing measures or the oxidized end product in the calcine solubilizes to a presently to us unacceptable level during leaching and/or after the tailings have been discarded and stored in a heap.

It has been discovered that an improved process for precious metal recovery from these refractory ores or their concentrates or tailings may be practiced with improved yields. Thus, not only can improved yields be achieved in an economically efficient manner, but also the problem of arsenic volatilization can be controlled. As a side benefit, fluorine (while present in very small amounts in the form of HF) is also converted to an unknown insoluble form in the calcine such that only a small percentage must further be treated thereby reducing fluorine levels. On an elemental basis, the levels achieved by the present process are far below the present day required limits. Furthermore, the lower temperatures and lower oxygen concentrations make the process more economically efficient. The process for the recovery of precious metals from refractory ores or their concentrates or tailings (here referred to generically for the sake of simplicity simply as "ore" or "ore material") which include arsenic-, carbon- and sulfur-containing components according to the present invention includes roasting that ore in an oxygen-enriched gaseous atmosphere such as oxygen augmented air having an initial oxygen content of less than about 65 percent by volume and recovering the thus-roasted ore, whereby the ore is amenable to recovery of the precious metal values in it. However, such treatment is also related to the iron content, e.g., as pyrites in the ore, the partition of arsenic between oxidation and reaction with an iron compound in the ore and the role of iron in added form (if addition is necessary to the ore) the conversion of arsenic to scorodite or scorodite like compounds during roasting and like effects.

Preferably, the ore is roasted in the form of fluidized solids, and more desirably, the ore circulates as fluidized solids in a circulating fluidized bed or in an ebullating fluidized bed (which has a circulation feature to it). The precious metal content can be recovered from the thus-roasted ore or ore concentrate or tailings by separation of cyanide consuming components by solubilization of these and then leaching through cyanidation, carbon-in-leach cyanidation or carbon-in-pulp cyanidation.

The process of the present invention is suitable for use on candidate precious metal ores having arsenic-, sulfur- and carbon-containing components. Typically, iron is in the form of the sulfides in such ores. These ores may have the following levels of these components on a percent by weight basis:

| | |
|---|---|
| Arsenic | up to 1.0% or higher |
| Carbon | 2.5% Maximum |
| Sulfur | 5.0% Maximum |

(all percentages are on a weight-to-weight basis unless otherwise stated.)

The ore is primarily pyritic-carbonaceous-siliceous. Candidate ores may be found in the region around Carlin, Nevada. Other types of ores which may be used have been identified as siliceous-argillaceous-carbonate-pyritic, pyritic-siliceous, and carbonaceous-siliceous. Small amounts of dolomite, calcite and other carbonate materials may be present in the ore.

| | |
|---|---|
| Quartz | 60–85 Percent |
| Pyrite | 1–10 Percent |
| Carbonate | 0–30 Percent |
| Kaolinite | 0–10 Percent |
| $Fe_xO_y$ | 0–5 Percent |
| Illite | 0–5 Percent |
| Alunite | 0–4 Percent |
| Barite | 0–4 Percent |

A typical chemical analysis of the ore shows an average composition as follows:

| | |
|---|---|
| Arsenic | 0.2 Percent |
| Sulfur (Total) | 4.0 Percent |
| Carbon (Total) | 1.0 Percent |

-continued

| | |
|---|---|
| Iron | 3.5 Percent |
| Zinc | 0.08 Percent |
| Strontium | 0.03 Percent |
| Gold | 0.15 Ounces per ton |

This ore, if so treated, typically shows gold recovery of less than 10 percent by simple cyanidation and less than 20 percent by simple carbon-in-leach cyanidation.

On the other hand, gold recovery by using the process of the present invention yields from about 75 percent to about 90 percent (and even higher) gold recovery.

While the primary application of the present invention relates to ores (as opposed to ore concentrates or tailings), it appears that ore concentrates may be used or that ore tailings may be used from the recovery of precious metal, or other values. The term "ore" as it is used throughout the remainder of this description encompasses and contemplates not only ores but also ore concentrates and ore tailings.

The ore is comminuted, or ground, before roasting to a range of particle sizes, i.e., from about 50% to about 90% passing through a 200 mesh (-200M) sieve, and of a set moisture content, i.e., from about 0% (and preferably less than about 1%)

Next, the ground ore is roasted in an oxygen-enriched gaseous atmosphere wherein the carbon and sulfur content is substantially completely oxidized from an initial roaster feed to a final calcine content as follows:

| | ROASTER FEED | | FINAL CALCINE CONTENT | |
|---|---|---|---|---|
| COMPONENT | From About | To About | From About | To About |
| Arsenic | 0.1% | 1.0% | 0.1% | 1.0% |
| Carbon (total) | 0.5% | 2.5% | 0.02% | 0.1% |
| Sulfur (total) | 0.5% | 5.0% | 0.05% | 0.1% |

Ninety-eight percent or greater of the sulfur content and 90 percent or greater of the carbon content are respectively oxidized during roasting. An important consideration is the completeness of the oxidation of the carbon and sulfur values. Final carbon values at 0.05% to 0.1% provide good results. The same applies to sulfide sulfur levels, with final sulfide sulfur values at 0.05% to 0.1% provided good results. The same applies to sulfide sulfur levels, with final sulfide sulfur values of 0.05% to 0.1% providing good results. However, the final carbon level is important since it can negatively affect gold recovery by "preg robbing" during the leaching operation.

While there is no seemingly apparent reduction in arsenic content, this is highly desirable since it is indicative of the lack of volatilization of the arsenic content and ability of iron to sequester and/or react with the arsenic in the ore and keep it in a form without causing any interference with gold recovery and subsequent long term arsenic solubilization. In other words, the arsenic content is beneficially retained in the solid phase ore/calcine rather than being volatilized (with a consequent need for supplemental precautionary measures).

Typically, greater than about 95% of the arsenic is fixed in the calcine by the presence of a proper amount of iron. If desired, additional iron may be added to facilitate this conversion to an insoluble form. By having greater than a ratio from about 3.5:1 and e.g. 4:1 of iron to arsenic (molar ratio), ferricarsenate compounds formed during roasting render the arsenic in a fixed form in the calcine. Further, the ferricarsenate compound is insoluble in the subsequent leaching and from the tailings in dump storage after the gold values are extracted. Consequently, not only are the arsenic values not volatilized by the process of the present invention by retaining these in the calcine in a nonvolatile form, but also these arsenic values can be retained in a form which is insoluble to the leaching and insoluble over long period while in a dump. A triple benefit results - reduced arsenic volatilization, long-term arsenic immobilization, and no impairment of gold recovery.

In the present invention the reaction temperature of the oxygen-enriched gaseous atmosphere during roasting is controlled so that it is from about 475 degrees Celsius to about 600 degrees Celsius. In addition to the need to prevent arsenic volatilization and/or solubilization, sintering should also be prevented since silicates formed by sintering make the precious metal content of the ore less amenable to recovery. Further, the reaction temperatures in the reactor apparatus must be sufficiently high to optimize the oxidation reaction, particularly the oxidation of carbon- and sulfur-containing components and formation of ferricarsenate compounds. It has been found that a reaction temperature in the reaction apparatus for the oxygen-enriched gaseous atmosphere of from about 475 degrees Celsius to about 600 degrees Celsius is desirable, while a preferred temperature range is from about 500 degrees Celsius to about 575 degrees Celsius.

While the objective of the oxidation of the carbon and sulfur content is the formation of oxides wherein carbon and sulfur are as completely oxidized as possible, the situation with respect to arsenic has more subtle ramifications since certain of its intermediate oxides, such as arsenic trioxide ($As_2O_3$) (boiling point 465° C.), volatilize at elevated temperatures as do certain of its sulfides, such as $As_2S_2$ (boiling point 565° C.), and $As_2S_5$ (sublimates at 500° C.). The focus, therefore, is on the formation of ferricarsenate compounds, such as scorodite, to avoid this volatization problem and to keep arsenic values out of the process off-gas and keep these in a highly insoluble state. This control is on of the desirable results that the present invention achieves by a combination of steps including the reaction conditions, oxygen content, roasting residence time, iron content, etc.

The gaseous atmosphere in which the ore is roasted is an oxygen-enriched gaseous atmosphere, such as oxygen-enriched air, having a total initial oxygen content, after enrichment, of less than about 65 percent (by volume), and desirably from about 25 percent (by volume) to about 60 percent (by volume); industrially a range of oxygen of 35% to 55% by volume is indicated for the process.

The ground or is roasted as fluidized solids in the oxygen-enriched gaseous environment. In effect, the fluidized ore in the gaseous roasting atmosphere forms a two phase suspension in which ore is a discontinuous phase composed of discrete solid particles and the gaseous atmosphere is the continuous phase. In most instances, the ore concentrates will have sufficient oxidizable content that there will be an autothermal oxidation reaction during roasting. In those instances where there is not sufficient oxidizable content, such as for ore which does not support an autothermal reaction, additional oxidizable content is provided by adding a comburant so that there will be a thermal reaction during roasting. Typically a low ignition point fuel is added, e.g. coal or butane/propane. Hence, desirably the ignition point should be that of propane or below.

Fluidizing the ore facilitates the transfer of reactants and heat produced by the oxidation reaction, i.e., from the ore to the gaseous atmosphere and vice versa. It also increases both reaction velocity and reaction uniformity. Further, as a result of these factors and the law of mass reaction, reaction of the iron and arsenic values to ferricarsenate compounds and, therefore, arsenic volatilization can be controlled. The reaction pathway for iron and arsenic values appears to be the oxidation of iron and arsenic values to form ferricarsenates. Because of the great complexity of reactions in any ore during roasting such pathway as arsenic to ferricarsenate is merely surmised but the important point is e.g. the scorodite formation.

While the oxidation reaction of the carbon- and sulfur-containing components is generally exothermic, it may be necessary to raise initially the temperature of the ore and the temperature of the gaseous reaction atmosphere in order to initiate the oxidation. This ma be accomplished by initially adding a comburant, such as a carbonaceous comburant like coal, propane or butane typically coal; or other low combustion, i.e. ignition point fuel. Moreover, if the stoichiometry of the ore is such that supplemental heat input is needed, the below-described fluid beds lend themselves well to such supplementation without any disadvantages.

Desirably, the fluidized ore solids are circulated in the form of a circulating fluidized bed. As another embodiment, an ebullating bed may be used with the overflow from the ebullating bed being constantly circulated. Efficiency and control over the oxidation and reaction conditions are improved by circulating the ore as fluidized solids. An advantage of a circulating fluid bed is the precise control of the bed temperature; and although an employed temperature is ore specific within the above ranges, the control is maintained within ±15° C. in a broader aspect; with ±10° C. being more typical and ±5° C. being preferred. Such temperature range permits even greater control over oxidation of the arsenic-, carbon- and sulfur-containing components and over reaction of the iron- and arsenic-containing components with each other while minimizing arsenic volatilization. Circulating fluidized bed technology is discussed in e.g. G. Folland et al., "Lurgi's Circulating Fluid Bed Applied to Gold Roasting", E & MJ, 28–30 (October 1989) and Paul Broedermann, "Calcining of Fine-Grained Materials in the Circulating Fluid Bed", *Lurgi Express Information Bulletin - C* 1384/3.81, the disclosures of which are incorporated herein by reference.

The residence time of the ore in the oxygen-enriched gaseous atmosphere should be from about 8 to 10 minutes preferably from about 10 minutes to about 12 or more, but constrained by practical design considerations such as vessel size; pump size etc. It should be understood that residence time is a function of ore mineralogy. Control of residence time at temperature also controls silicate melting which is to be avoided since the porosity created by sulfidic sulfur oxidation is then vitiated. High porosity and low sintering is desirable for the subsequent leaching of gold.

Following roasting, the precious metal values are recovered from the thus-roasted ore, or calcine, by leaching, such as by cyanidation, carbon-in-leach cyanidation or carbon-in-pulp cyanidation. Such leaching techniques are known in the art and are described in general in U.S. Pat. Nos. 4,902,345 and 4,923,510, whose disclosures are incorporated herein by reference.

As a benchmark comparison of the roasting efficiency and completion of the present invention, conventional fluid bed roasting for equivalent length of time at the same conditions provides a measure by which the present invention may be evaluated. Another measure of efficiency and completion are the amount of cyanide used to extract an equivalent amount of gold, or residual amounts of gold in ore after standard extraction procedures. According to the above measures, evaluation of ore of the same mineralogy will give the outstanding advantages of the present invention.

The thus-roasted ore may be subjected to an oxygen or chlorine treatment after roasting and prior to leaching. This treatment may be in the form of bubbling gaseous oxygen or chlorine through a suspension or a slurry of the thus-roasted ore either in a bath at ambient pressure or in a closed vessel at ambient or elevated pressure prior to leaching the ore.

The precious metal recovery provided by the present invention from refractory ores which include arsenic-, carbon- and sulfur-containing components is much improved, reaching levels of 75–90% and in some cases higher, such as 92%. It must be understood that the mineralogy of the ore will influence the results. Conventionally pyritic sulfides, sulfides and carbon affect recovery and higher or lower arsenic content makes it more or less expensive to treat the ore to meet today's environmental demands.

DESCRIPTION OF THE ILLUSTRATIONS SHOWN IN THE DRAWING

In FIG. 1 a self-explanatory flow diagram has been provided. This generic flow diagram should be considered in combination with a schematic industrial embodiment shown in FIG. 7 and also amplified further herein by the data shown in Table 7.

As one of the advantageous aspects of this invention, heat recovery (i.e. as a cost advantage) in this process may be readily practiced. For example heat may be recovered not only from the off-gases from the one stage roasting such as derived from a circulating fluid bed or an ebullating fluid bed, but also by cooling a calcine with air or air enriched with oxygen e.g. of up to 65% oxygen by volume. Such air cooling is taught in U.S. Pat. 4,919,715 to supposedly reduce the recovery of gold, apparently by as much as 2%, but we have found it not to be detrimental, if anything, such heat recuperation seems to have improved the yields.

Another aspect of the invention which has not been mentioned or apparent from the immediately above-mentioned patent is that subsequent liquid quenching allows reduction of cyanide consuming materials. These materials are rendered soluble by the low temperature oxygen roasting and low temperature oxygen post-finishing of the calcine during cooling. Such post-finishing provides excellent sulfation at acidic conditions, e.g. making of $Fe_2(SO_4)_3$ and like compounds of metals such as copper, nickel, antimony, zinc, lead, etc. The removal of these compounds during liquid quench reduces cyanide consumption during leaching from 2 to 10 pounds more typically from 5 to 10 pounds of cyanide per ton of calcine to less than one pound e.g. typically 0.3 pound of cyanide per ton of calcine.

Figure 2:
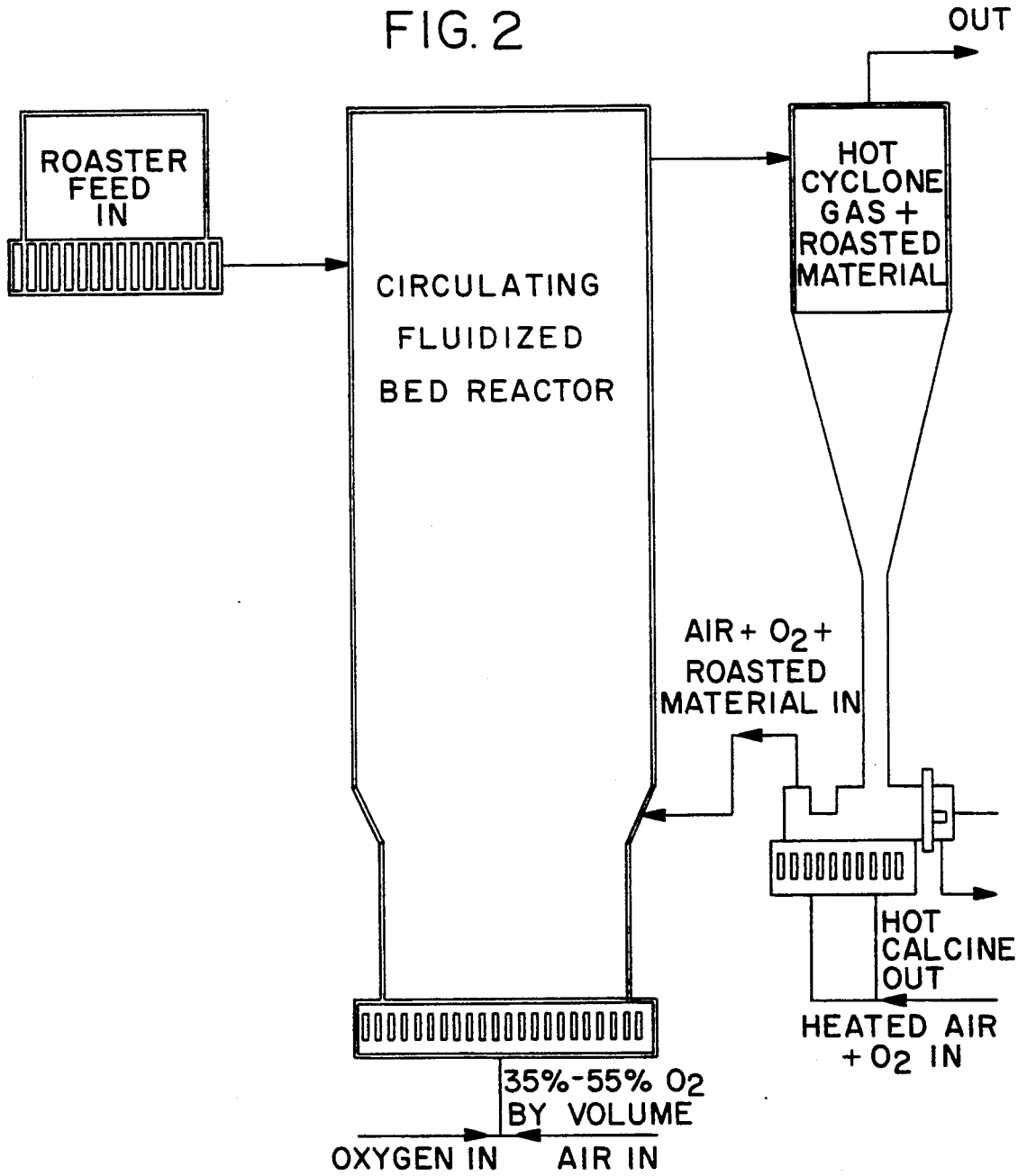
FIG. 2 is a side elevation in vertical section of the roasting apparatus in accordance with the present invention showing a circulating fluidized bed.

In FIG. 2 a schematic representation of appropriately labeled circulating fluidized bed (CFB) has been shown. The air input at the bottom of the bed with the recirculating material from the hot cyclone (or a plurality of cyclones in parallel, e.g. two) keep the bed in a high degree of turbulence assuring excellent i.e. almost instantaneous temperature uniformity and reaction conditions. Typically the complete residence time in such bed may be based on a number of passes of the bed contents through the bed, but it is best to express it as overall nominal residence time for the bed contents. It should be understood that a residence time is a summation time of the circulating particles in such bed. It is believed that the post-finishing of the calcine during cooling has the above-mentioned advantageous effect for any particle which may have escaped the necessary residence time in the circulating fluid bed, yet at no overall reduction of residence efficiency and gold recovery.

Figure 3:
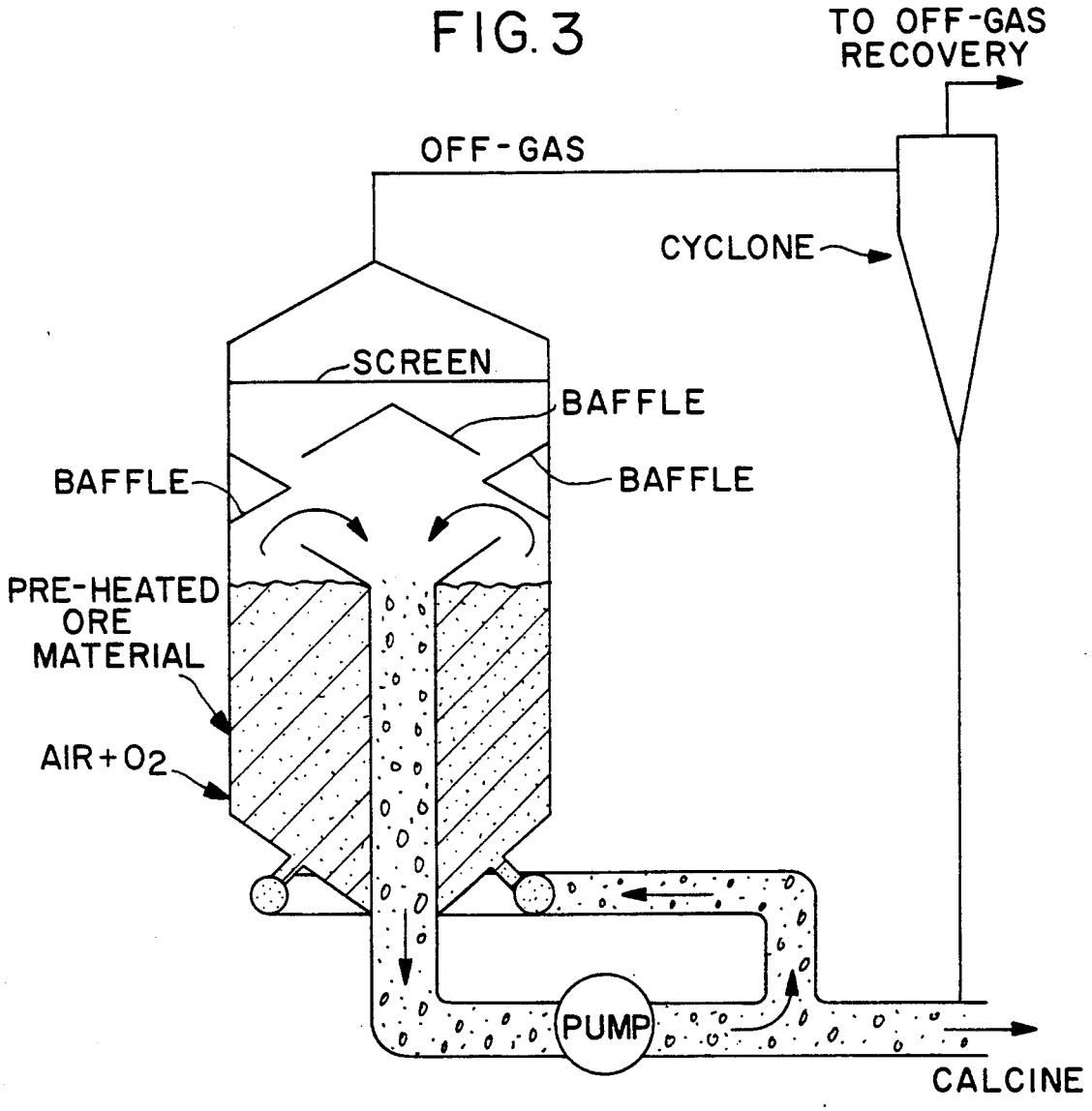
FIG. 3 is a side elevation in vertical section of the roasting apparatus in accordance with the present invention showing an ebullating fluidized bed.

FIG. 3 shows an ebullating fluid bed which is an embodiment of a fluid bed suitable as another approach in the disclosed process. The appropriately labeled illustration provides for another circulation approach when roasting an ore material.

Figure 4:
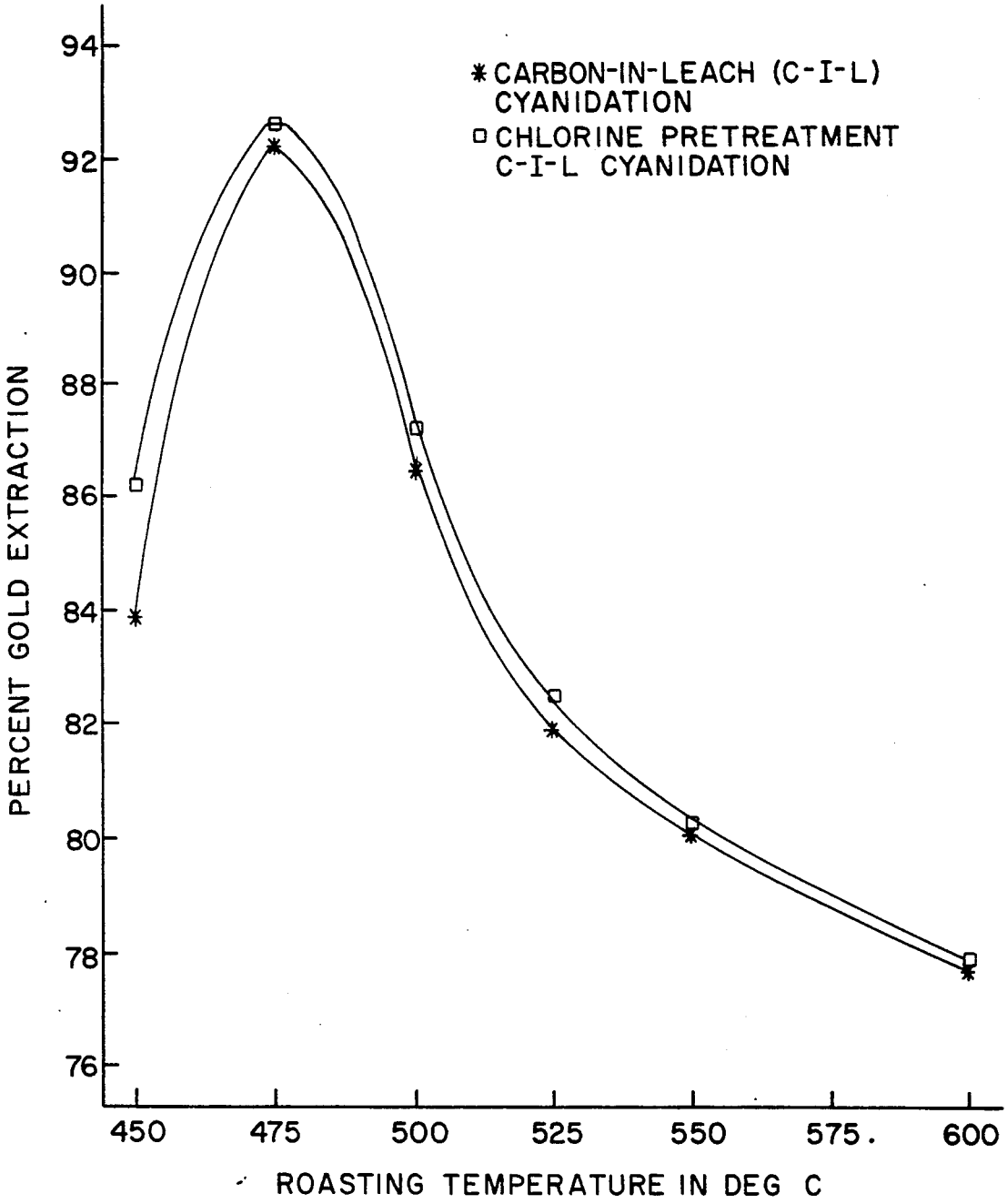
FIG. 4 is a graph of the percent of gold extraction versus the reaction temperature of the oxygen-enriched gaseous atmosphere during roasting based on both leaching with a carbon-in-leach/sodium cyanide leaching and a carbon-in-leach/sodium cyanide leaching with a sodium hypochlorite pretreatment of the roasted ore.
Figure 5:
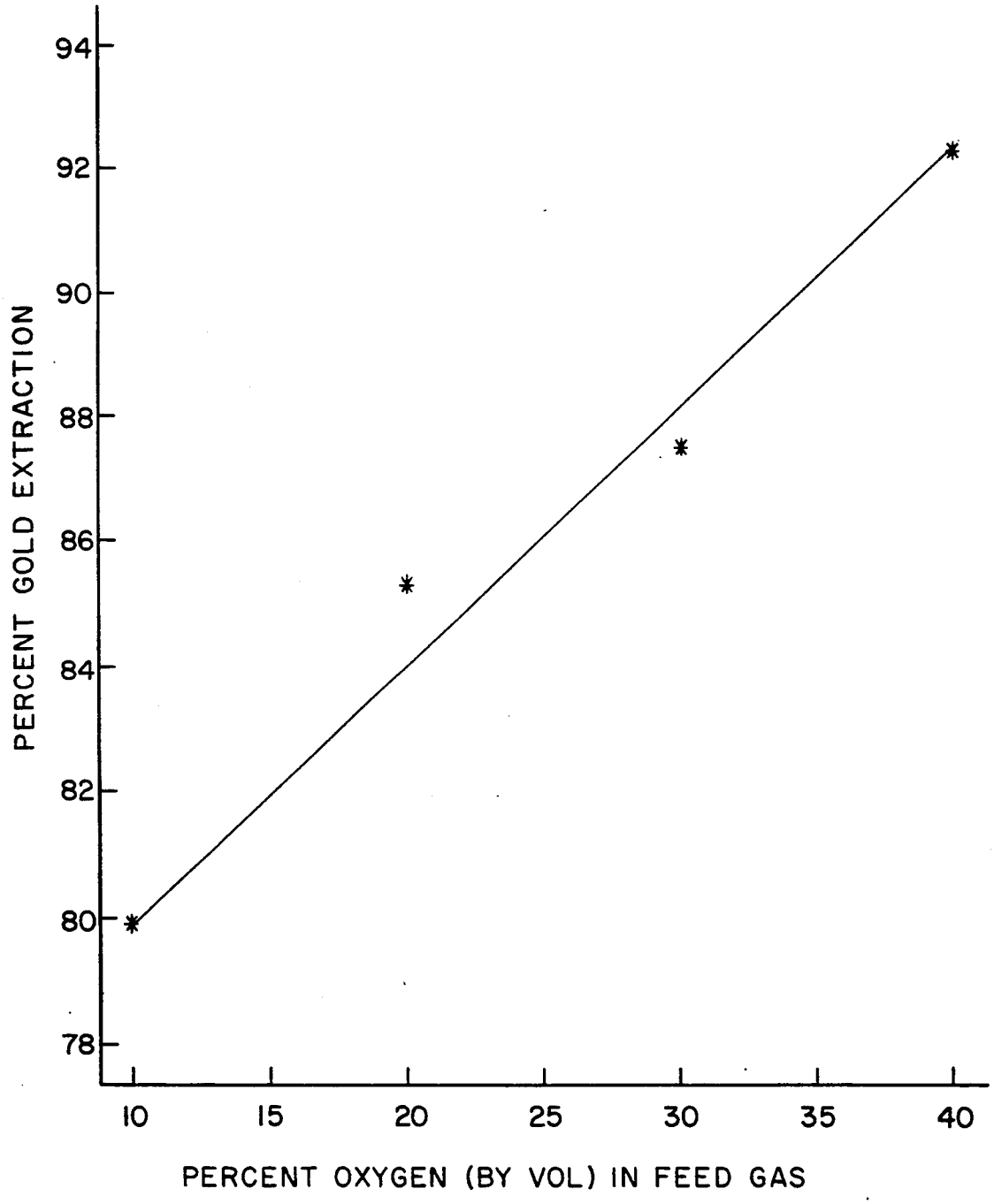
FIG. 5 is a graph of the percent gold extraction versus the percent oxygen by volume in the feed gas to the oxygen-enriched gaseous roasting atmosphere.
Figure 6:
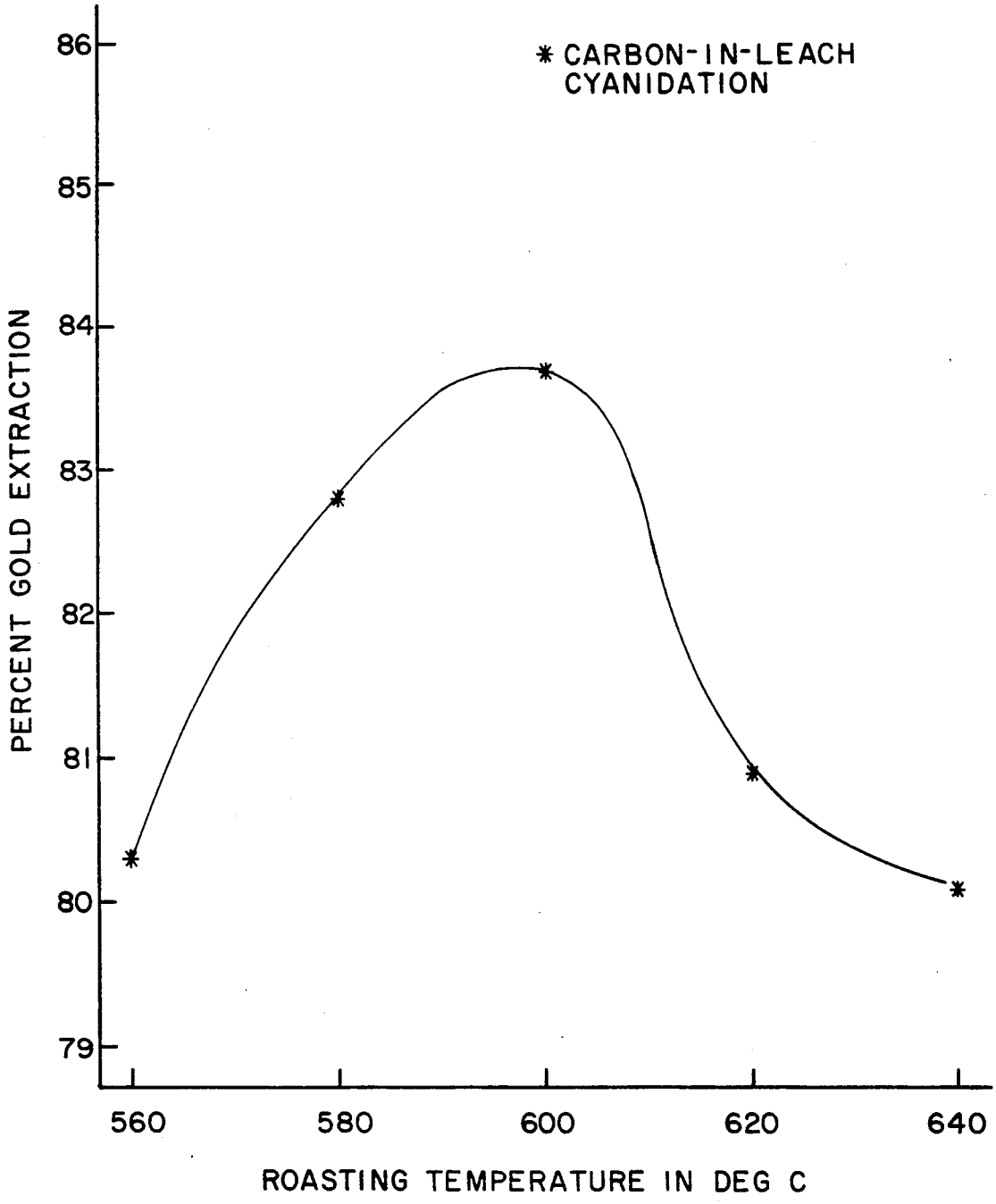
FIG. 6 is a graph of the percent of gold extraction versus the reaction temperature of the air atmosphere during roasting based on leaching with carbon-in-leach-/sodium cyanide leaching of the roasted ore.

FIGS. 4 to 6 will be further explained in conjunction with the Examples. FIGS. 4 and 6 illustrate the "knee-in-the-curve" found for the roasting conditions existing as a function of roasting temperature, oxygen content in roasting gas i.e. air, and as a function of gold extraction.

Figure 7:
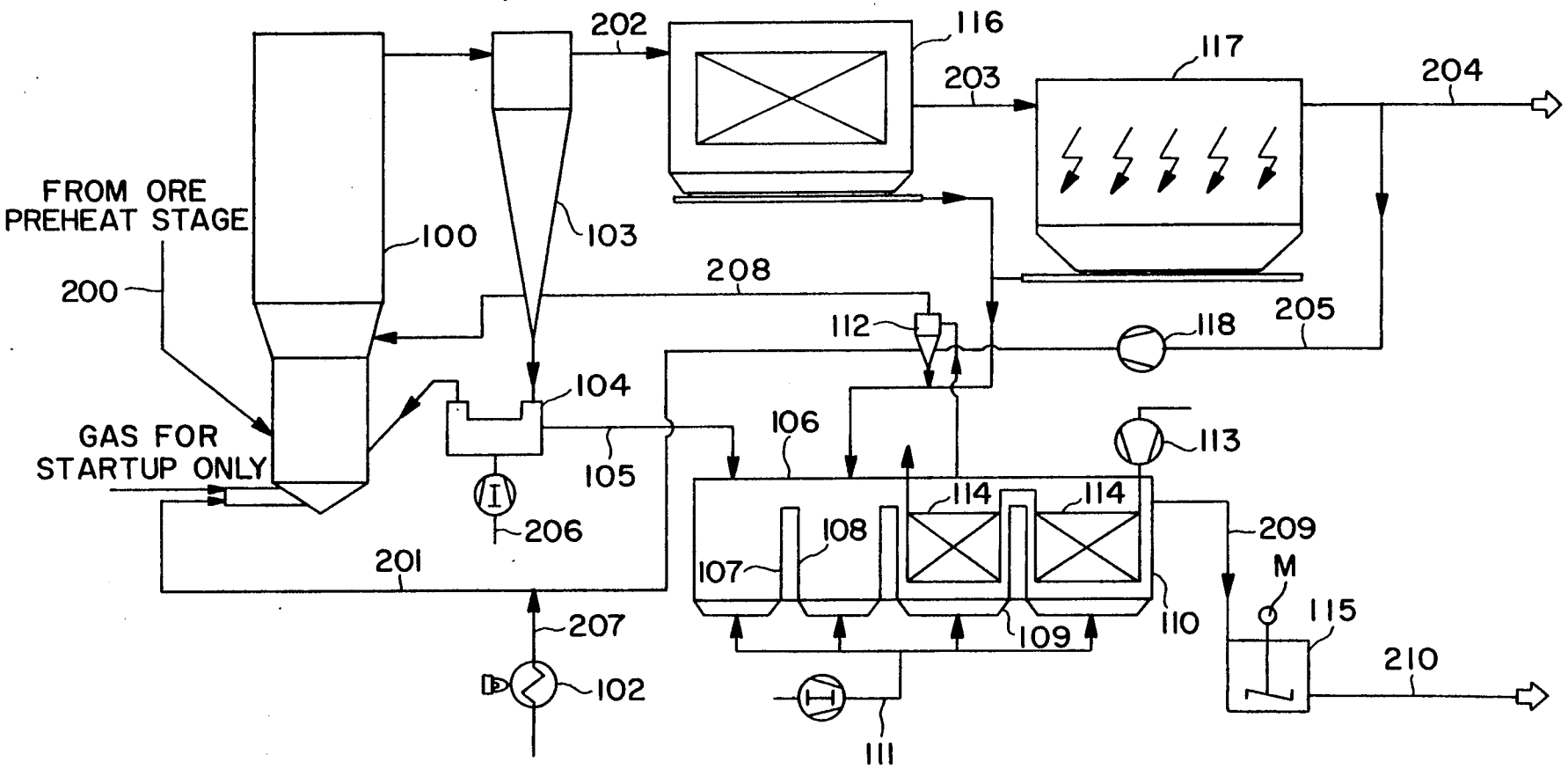
FIG. 7 is a schematic drawing of an industrial embodiment of the present invention.

In FIG. 7 an embodiment showing a schematic industrial application of the process is illustrated in greater detail and amplifies the flow chart of FIG. 1.

A circulating fluid bed (CFB) reactor 100 is fed from an ore preheat stage identified with stream 200 corresponding to the same stream number in Table 7 further disclosed herein. A start-up gas stream such as butane/propane has been shown entering the CFB reactor 100 at the bottom thereof. Additionally, a combined stream of unexhausted off-gas and fresh oxygen via preheater 102 is introduced into the CFB reactor 100. The combined stream is identified as 201. Further, a preheated, oxygen supplemented air stream 208 is introduced in the CFB reactor 100 and is coming from the post-finishing calcine treatment which will be discussed below. A single cyclone 103 has been shown in FIG. 7, but more than one may be operated in parallel to assure greater particulate removal from the off-gas. Cyclone 103 bottoms i.e. underflow collections are partially reintroduced into the CFB reactor 100 via seal pot 104. A slip stream 105 of calcined product is also taken from seal pot 104 and introduced into a four stage pre-heaters (recuperators) 107 to 110 which are in a heat recovery unit 106. Air augmented with oxygen is brought up to about 450° C. in heat recovery unit 106. The unit 106 consists of four pre-heaters in the form of fluidized beds 107, 108, 109 and 110, respectively. Because the conditions in each of the pre-heater beds are different, these pre-heaters 107, 108, 109 and 110 have been identified by separate numbers. Typically, the CFB reactor 100 is operated at 550° C. The resulting calcine (of retention time of 10 minutes in reactor 100) is introduced in the first pre-heater 107. The calcine is at a temperature of about 525° C. and has a residence time of about 15 minutes in preheater 107; in the second pre-heater 108, the calcine temperature is about 475° C. and residence time is about 10 minutes; in the third pre-heater 109 the calcine temperature is at about 420° C. and the residence time is about 8 minutes; in the fourth pre-heater 110 the calcine temperature is about 350° C. and the residence time is about eight minutes. Air and oxygen enter these preheaters in parallel, fluidize the calcine, and are mixed and cleaned in cyclone 112. After separation of particulates in cyclone 112, air and oxygen as mixture is introduced as stream 208 into the CFB reactor 100. A second pre-heater unit (not shown) of the same type may be operated in parallel to the first pre-heater unit 106. The seal pot 104 or a second seal pot (not shown) may feed the second pre-heater unit. In the data shown in Table 7, these are referred to two parallel identical pre-heater units such as 106, two parallel cyclones such as 112, and two parallel seal pots such as 104.

Heated air and oxygen mixture from all four pre-heaters is used and is at about 450° C. as shown in Table 7. However, in addition ambient air is introduced via pump 113 into heating coils 114 immersed in the fluidized calcine in pre-heaters 109 and 110. This air is used to pre-heat in a CFB type vessel (not shown) the ore introduced as stream 200 in the CFB reactor 100. Hot air exits heating coils 114 at 200° C. As contemplated, but subject to change in the mineralogy of the ore, the balance of the energy requirement for roasting is made up by the addition of pulverized coal to the CFB reactor 100. Calcine in stream 209 is quenched in water in tank 115 to a 15% solids content and further worked-up as previously described for removal of cyanicide materials, neutralization and subsequent leaching.

Off-gases, i.e. cyclone 103 overflows are introduced into a waste heat boiler 116 where the off-gas temperature is reduced to about 375° C., dust from the waste heat boiler 116 is introduced into the pre-heater unit in an appropriate place, e.g. pre-heater 108 and combined with calcine. From waste heat boiler 116, the off gases are introduced into an electrostatic precipitator 117, e.g. a five field, hot electrostatic precipitator, to remove substantially all residual dust in the off-gas. A number of precipitators 117 may be used. The exit temperature of the off-gas from the electrostatic precipitator 117 is at about 350° C. the off-gas comprises about 36% by volume of oxygen. About half of the exit gases are recycled via pump 118 to the CFB reactor 100. This recycle is a significant benefit because the off-gas cleaning system becomes about half the size if the off-gas is recycled. Precipitates i.e. dust from the electrostatic precipitator are also introduced into the calcine in pre-heat unit(s) 106.

In accordance with the present invention, a series of experimental runs were conducted which established the significant process parameters which show the previously unachieved results of which the present invention is capable.

The following examples illustrate the process of the present invention in the context of the recovery of gold.

EXAMPLE 1

The ore used in these runs came from a random sampling of arsenic-, sulfidic-, organic carbon-containing, gold-bearing ores from the region around Carlin, Nevada. This ore, for the series of runs showed an average gold content of about 0.16 ounces of gold per ton of ore and up to 0.20 oz. of gold per ton, an average content of 0.08 percent arsenic, 2.49 percent sulfide sulfur (2.81 percent total sulfur) and 0.79 percent organic carbon (0.84 percent total carbon.) The ore was classified as pyritic-carbonaceous-siliceous or and had the following mineralogical and chemical analyses:

| Mineralogical Analysis | |
|---|---|
| A typical analysis of this ore shows: | |
| Quartz | 68 Percent |
| Kaolinite | 10 Percent |
| Sericite or Illites | 8 Percent |
| Pyrite | 5 Percent |
| Jarosite | 4 Percent |
| Alunite | 3 Percent |
| $Fe_xO_y$ | 1 Percent |
| Barite | 1 Percent |
| Carbonates | 0 Percent |

| Chemical Analysis | |
|---|---|
| A chemical analysis of the ore shows an average composition as follows: | |
| Arsenic | 824 parts per million |
| Carbon (Total) | 0.84 Percent |
| Sulfur (Total) | 2.81 Percent |
| Gold | 0.164 ounces per ton |
| Iron | 4.0 Percent |
| Zinc | 400 parts per million |
| Strontium | 0.02 Percent |

The ore was ground in a small ball mill to 100 percent -65 mesh (except as otherwise noted), i.e., 100 percent passed through a 65 mesh sieve, and it had a bulk density of about 57 pounds per cubic foot and a moisture content of about 1 percent.

The ground ore was placed in a simple rotating tube reactor and roasted in a batch operation to evaluate various reaction conditions using a residence time of two hours for the sake of consistency.

The roasted ore, or calcine, was treated by a carbon-in-leach cyanidation leach using a dosage of 6 pounds of sodium cyanide per ton of roasted ore and 30 grams per liter of activated carbon (available from North American Carbon.)

The leaching was conducted in a continuously rolling bottle under the following conditions:

1. 200 grams of calcine per leach test
2. 40% solids and
3. 24 hours leaching time.

A first series of runs was made roasting the ore with 40% oxygen (by volume) initially in the feed gas, or gaseous atmosphere, at the following temperatures and with the following results:

| Roasting Temperature (Degree C.) | Gold Extraction (Percent) |
|---|---|
| 450 | 84 |
| 475 | 92 |
| 500 | 86.5 |
| 525 | 82 |
| 550 | 80 |
| 600 | 76.8 |

When the roasted ore is treated with sodium hypochlorite at a rate of 25 pounds per ton of ore and using the same leaching technique, the results were as follows:

| Roasting Temperature (Degree C.) | Gold Extraction (Percent) | Arsenic in ppm | Tailings % |
|---|---|---|---|
| 450 | 86 | 939 | 0.094 |
| 475 | 92.5 | 913 | 0.091 |
| 500 | 87.3 | 934 | 0.093 |
| 525 | 82.5 | 918 | 0.092 |
| 550 | 80.3 | 950 | 0.095 |
| 600 | 78 | 898 | 0.090 |

(The symbol □ on the graph in FIG. 4 also shows these results.)

A second run was undertaken in which the roasting temperature was held at 475 degrees Centigrade and the retention time at 2 hours, but the percent oxygen (by volume) in the feed gas, i.e., the total initial oxygen content of the gaseous atmosphere, was varied as follows and the following percentages of gold extraction were observed:

| Total Oxygen (by Volume) in Feed Gas (air + added oxygen) (Percent) | Gold Extraction (Percent) |
|---|---|
| 10 | 80 |
| 20 | 85.5 |
| 30 | 87.5 |
| 40 | 92 |

(These results are also shown in the graph of FIG. 5.)

Further, the following additional results were observed in the roasted ore and are set forth in Table 1.

TABLE 1

CALCINE ASSAYS AND LEACH RESULTS

| TOTAL INITIAL OXYGEN % | ARSENIC (PERCENT) % | SULFUR (SULFIDE) % | CARBON (ORGANIC)[1] % | GOLD[2] oz/ton | LEACH RESIDUE[3] oz/ton | CALCULATED HEAD[4] oz/ton | GOLD EXTRN. % | −200 MESH[5] % |
|---|---|---|---|---|---|---|---|---|
| 10 | 0.082 | 0.31 | 0.17 | 0.169 | 0.033 | 0.164 | 79.9 | 84.7 |
| 20 | 0.085 | 0.20 | 0.08 | 0.164 | 0.025 | 0.170 | 85.3 | 80.5 |
| 30 | 0.080 | 0.30 | 0.05 | 0.165 | 0.021 | 0.166 | 87.5 | 83.1 |
| 40[6] | 0.091 | 0.48 | 0.05 | 0.162 | 0.013 | 0.161 | 92.2 | 81.6 |

[1]Organic carbon is defined as acid insoluble carbon to distinguish from carbonates which are acid soluble.
[2]By fire assay determination.
[3]By fire assay determination.
[4]Calculated head is a comparison to the fire assay by using leach residue weight and loaded carbon weight and fire assay. It is used to make a material balance determination to ensure that there has been good gold accountability in the test.
[5]Through a 200 mesh sieve.
[6]This was conducted on material which passed through a 20 mesh sieve standard test procedure.

EXAMPLE 2

A series of air roasting tests was run in a six-inch rotating tube furnace with off gas oxygen content. (This resulted in approximately 4% to 6% oxygen by volume in the off-gas.) These tests used specimens of the same composition as the sample used in Example 1. The ore for this series of test runs showed an average gold context of about 0.164 ounces of gold per ton, 2.49 percent sulfide sulfur and 0.79 percent organic carbon. The ore was classified as sulfidic-carbonaceous ore. Sample preparation and test procedures used were the same as in Example 1. Table 2 and FIG. 5 present the test results. These tests demonstrate that low gold recoveries are achieved when roasting is conducted with air as the oxidizing atmosphere. These tests also demonstrate that the process of the present invention using oxygen-enriched air (such as 40% oxygen by volume) allows better process control—at lower temperatures—for maximum gold recoveries.

-continued

| Chemical Analysis | |
|---|---|
| An elemental analysis of the ore shows an average composition as follows: | |
| Gold | 0.14 Percent |
| Iron | 2.0 Percent |
| Zinc | 0.06 Percent |
| Strontium | 0.05 Percent |

The ore was ground in a small ball mill to 100 percent -100 mesh, i.e., 100 percent passed through a 100 mesh sieve (except as otherwise noted) and it had a bulk density of approximately 62 pounds per cubic foot and a moisture content of approximately 1 percent.

TABLE 2

CALCINE ASSAY AND LEACH RESULTS - ROASTING IN AIR

| ROAST CONDITIONS | | | CALCINE HEAD ASSAYS | | | | | LEACH TEST RESULTS | | | |
|---|---|---|---|---|---|---|---|---|---|---|---|
| TEST NO. | TEMP °C. | WT. LOSS % | S[1] % | C[2] % | As ppm | Hg ppm | Au oz/ton | Au in LEACH TAIL oz/ton | CALC HEAD[3] oz/ton | AU EXTRN % | −200 MESH[4] % |
| 2-1 | 560 | 4.7 | .07 | .05 | 948 | .26 | .166 | .033 | .168 | 80.3 | 66.3 |
| 2-2 | 580 | 4.8 | .10 | .09 | 894 | .18 | .170 | .029 | .167 | 82.8 | 68.7 |
| 2-3 | 600 | 5.3 | .05 | .04 | 926 | .19 | .165 | .027 | .166 | 83.7 | 76.1 |
| 2-4 | 620 | 5.2 | .06 | .08 | 945 | .11 | .166 | .032 | .168 | 80.9 | 68.9 |
| 2-5 | 640 | 5.1 | .09 | .02 | 981 | .09 | .167 | .034 | .171 | 80.1 | 68.6 |

[1]Sulfide Sulfur.

[2]Organic carbon as residue after hydrochloric acid digestion.

[3]Calculated head is a comparison to the fire assay by using leach residue weight and loaded carbon weight and fire assay. It is used to make a material balance determination to ensure that there has been good gold accountability in the test.

[4]Percent through a 200 mesh sieve.

EXAMPLE 3

The ore used in these runs came from a random sampling of arsenic-, sulfidic-containing, gold bearing ores from the region around Carlin, Nevada. The ore for this series of runs showed an average gold content of about 0.14 ounces of gold per ton of ore, an average content of 0.15 percent arsenic, 2.15 percent sulfide sulfur (2.50 percent total sulfur) and 0.35 percent organic carbon (0.39 percent total carbon.) The ore was classified as pyritic-siliceous ore and had the following mineralogical analysis:

| Mineralogical Analysis | |
|---|---|
| A typical analysis of this ore shows: | |
| Quartz | 80 Percent |
| Sericite | 6 Percent |
| Pyrites | 4 Percent |
| Jarosite | 4 Percent |
| Kaolinite | 3 Percent |
| Alunite | 2 Percent |
| Barite | 1 Percent |
| $Fe_xO_y$ | 0 Percent |

| Chemical Analysis | |
|---|---|
| An elemental analysis of the ore shows an average composition as follows: | |
| Arsenic | 0.15 Percent |
| Carbon (Organic) | 0.35 Percent |
| Sulfur (Sulfide) | 2.15 Percent |

The ground ore was placed in a simple rotating tube reactor and roasted in a batch operation to evaluate various reaction conditions using a residence time of two hours for the sake of consistency. The ore feed to roast was 800 grams at -100 mesh.

The roasted ore, or calcine, was treated by a carbon-in-leach cyanidation leach using 5 pounds of sodium cyanide per ton of roasted ore and 30 grams per liter of activated carbon (available from North American Carbon.)

The leaching was conducted in a continuously rotating bottle under the following conditions:

1. 200 grams of calcine per leach test
2. 40% solids and
3. 24 hours leaching time.

The series of runs was made roasting the ore with 40% total oxygen (by volume) initially in the feed gas, or gaseous atmosphere, at the following temperatures and with the following results

| Roasting Temperature (Degree C.) | Gold Extraction (Percent) |
|---|---|
| 450 | 72.2 |
| 475 | 84.9 |
| 500 | 82.5 |
| 525 | 76.8 |
| 550 | 77.7 |
| 600 | 75.5 |

Table 3 shows these and additional results.

TABLE 3

CALCINE ASSAY AND LEACH RESULTS - ROASTING IN 40% OXYGEN

| ROAST CONDITIONS | | | | CALCINE HEAD ASSAYS | | | | | LEACH TEST RESULTS | | | |
|---|---|---|---|---|---|---|---|---|---|---|---|---|
| TEST NO. | TEMP °C. | FEED GAS[1] | WT. LOSS % | S[2] % | C[3] % | As ppm. | Hg ppm. | Au oz/ton | LEACH TAIL oz/ton | CALC.[4] HEAD oz/ton | GOLD EXTR % | −200 MESH[5] % |
| 3-1 | 450 | 40 | 1.2 | .88 | .09 | 1416 | .82 | .145 | .042 | .150 | 72.2 | 68.2 |
| 3-2 | 475 | 40 | 2.0 | .29 | .29 | 1394 | .22 | .148 | .023 | .153 | 84.9 | 67.8 |
| 3-3 | 500 | 40 | 2.6 | .18 | .18 | 1528 | .32 | .146 | .027 | .154 | 82.5 | 67.5 |
| 3-4 | 525 | 40 | 2.8 | .10 | .10 | 1546 | .14 | .148 | .036 | .155 | 76.8 | 67.8 |
| 3-5 | 550 | 40 | 3.0 | .04 | .01 | 1327 | .29 | .147 | .034 | .152 | 77.7 | 72.5 |
| 3-6 | 600 | 40 | 3.0 | .02 | .01 | 1236 | .30 | .149 | .038 | .155 | 75.5 | 71.4 |

[1]Total initial oxygen content, percent oxygen by volume.
[2]As sulfide.
[3]Organic carbon as a residue after hydrochloric acid digestion.
[4]Calculated head is a comparison to the fire assay by using leach residue weight and loaded carbon weight and fire assays. It is used to make a material balance determination to ensure that there has been good gold accountability in the test.
[5]Percent through a 200 mesh sieve.

EXAMPLE 4

A series of roast tests was run in a six-inch rotating tube furnace with air as the input stream. (This resulted in approximately 4% to 6% oxygen by volume in the off-gas.) Specimens from the same sample as in Example 3 were used for these tests. Sample preparation and test procedures were the same as in Example 1. Table 4 presents the test results. These tests also demonstrate that when comparing to Table 3 results, the former show that gold recovery is maximized when oxygen-enriched air, e.g., 40% total oxygen in the feed gas, is used as the oxidizing medium.

TABLE 4

CALCINE ASSAY AND LEACH RESULTS - AIR ROASTING

| ROAST CONDITIONS | | | | | CALCINE HEAD ASSAYS | | | | | LEACH TEST RESULTS | | | |
|---|---|---|---|---|---|---|---|---|---|---|---|---|---|
| TEST NO. | TEMP °C. | MESH SIZE[1] | TIME Hrs | WT. LOSS % | S[2] % | C[3] % | As ppm | Hg ppm | Au oz/ton | LEACH TAIL ozAu/ton | CALC HEAD oz/ton | GOLD EXTR % | −200 MESH % |
| 4-1 | 550 | −14 | 1.5 | 2.5 | .31 | .08 | 1125 | .54 | .146 | .043 | .148 | 70.8 | 81.7 |
| 4-2 | 550 | −14 | 2.5 | 2.7 | .22 | .06 | 1040 | .42 | .149 | .044 | .149 | 70.2 | 80.8 |
| 4-3 | 650 | −14 | 1.5 | 2.9 | .17 | .05 | 560 | .26 | .144 | .036 | .146 | 75.1 | 84.7 |
| 4-4 | 650 | −100 | 1.5 | 2.9 | .01 | .02 | 520 | .17 | .150 | .035 | .146 | 75.9 | 67.7 |
| 4-5 | 650 | −14 | 2.5 | 3.1 | .15 | .04 | 540 | .30 | .149 | .038 | .152 | 74.9 | 84.5 |
| 4-6 | 650 | −100 | 2.5 | 3.7 | .01 | .03 | 520 | .19 | .149 | .039 | .152 | 74.2 | 72.4 |
| 4-7 | 600 | −14 | 2 | 3.9 | .20 | .03 | 848 | .29 | .146 | .036 | .150 | 75.8 | 83.8 |
| 4-8 | 600 | −28 | 2 | 2.9 | .08 | .08 | 500 | .30 | .141 | .034 | .148 | 77.0 | 89.0 |

[1]Percent passed through a sieve of the specified mesh.
[2]Sulfide sulfur.
[3]Organic carbon as a residue after hydrochloric acid digestion.

EXAMPLE 5

A series of tests was conducted in a six-inch rotating tube furnace on a sample with high carbonate content to demonstrate that the high gold recoveries are achieved with the process of the present invention. For comparison, three air roasts are presented along with the example that illustrates the present invention. Sample preparation and test procedures used were the same as in Example 1. Table 5 shows the test results. The analysis of the sample was:

| Chemical Analysis | |
|---|---|
| Chemical Analysis | |
| Gold | 0.66 Ounces per ton |
| Carbon (total) | 3.5 Percent |
| Carbon (organic) | 0.0 Percent |
| Sulfur (total) | 2.6 Percent |
| Sulfur (sulfide) | 2.2 Percent |
| Iron | 2.8 Percent |
| Arsenic | 0.43 Percent |

-continued

| Chemical Analysis | |
|---|---|
| Chemical Analysis | |
| Mercury | 56 Parts per million |

| Mineralogical Analyses | | | |
|---|---|---|---|
| X-RAY Diffraction Analysis | | X-RAY Fluorescence Analysis | |
| Quartz | 29 Percent | Zirconium | .03 Percent |
| Sericite | 4 Percent | Titanium | .04 Percent |
| Kaolinite | 18 Percent | Barium | .85 Percent |
| Alunite | 26 Percent | Nickel | .02 Percent |
| Jarosite | 9 Percent | Vanadium | .02 Percent |
| Pyrite | 3 Percent | Strontium | .04 Percent |
| Barite | 1 Percent | Zinc | .03 Percent |
| $Fe_xO_y$ | 2 Percent | | |
| Diopside | 7 Percent | | |

TABLE 5

TEST RESULTS FOR THE HIGH CARBONATE SAMPLE

| ROAST TEMP. DEG. C. | LEACH RESIDUE Au oz/ton | GOLD EX-TRACTION % | −200 MESH[1] % | COMMENTS |
|---|---|---|---|---|
| 525 | .077 | 88 | 80 | Oxygen-Enriched Roast[2] |
| 550 | .105 | 84 | 80 | Air Roast[3] |
| 600 | .132 | 80 | 89 | Air Roast[3] |

TABLE 5-continued

| TEST RESULTS FOR THE HIGH CARBONATE SAMPLE | | | | |
|---|---|---|---|---|
| ROAST TEMP. DEG. C. | LEACH RESIDUE Au oz/ton | GOLD EX-TRACTION % | −200 MESH[1] % | COMMENTS |
| 650 | .138 | 79 | 86 | Air Roast[3] |

[1]Passed through a 200 mesh sieve
[2]Feed gas was air enriched to 40% total oxygen content (by volume.)
[3]Feed gas was air and the off-gas composition was maintained at 6% to 8% oxygen by volume.

EXAMPLE 6

A series of pilot plant tests was conducted in a six-inch fluidized bed reactor and an eight-inch fluidized bed reactor on a sulfidic carbonaceous sample with the following chemical and mineralogical composition:

Chemical Analysis

| Chemical Analysis | | |
|---|---|---|
| Gold | 0.13 | Ounces per ton |
| Carbon (total) | .82 | Percent |
| Carbon (organic) | .78 | Percent |
| Sulfur (total) | 3.1 | Percent |
| Sulfur (sulfide) | 2.6 | Percent |
| Iron | 2.7 | Percent |
| Arsenic | 0.09 | Percent |
| Mercury | 4.7 | Parts per million |

Mineralogical Analyses

| X-RAY Diffraction Analysis | | X-RAY Fluorescence Analysis | |
|---|---|---|---|
| Quartz | 71 Percent | Zirconium | 0.1 Percent |
| Sericite | 5 Percent | Titanium | .12 Percent |
| Kaolinite | 11 Percent | Barium | .85 Percent |
| Alunite | 3 Percent | Nickel | .03 Percent |
| Jarosite | 5 Percent | Vanadium | .05 Percent |
| Pyrite | 4 Percent | Strontium | .05 Percent |
| Barite | 1 Percent | Zinc | .10 Percent |
| $Fe_xO_y$ | 0 Percent | Lead | .01 Percent |

The sample preparation procedure for this series of tests included crushing, wet grinding in a ball mill to 100% passing through a 65 mesh sieve, solid/liquid separation, and drying prior to roasting. The dry sample was fed to the roaster via a screw feeder with the combustion gas consisting of either air alone or air enriched to 40% total initial oxygen content by volume. Solids exiting the roaster were carbon-in-leach cyanide leached at the same conditions as in Example 1.

Table 6 presents the test results. From the results it is seen that maximum gold recoveries are achieved by using the process of the present invention. By way of comparison, several air roasts conducted in a circulating fluidized bed roaster and a stationary fluid bed roaster are presented along with three examples that illustrate the present invention.

Residual sulfide sulfur content and organic carbon content of the solids exiting from the pilot plant roaster were less than 0.05 percent by weight in all the tests from this series.

TABLE 6

Test Results From Pilot Plant in Fluidized Bed Roasters

| ROAST TEMP. DEG. C. | OXYGEN IN OFF-GAS % | LEACH RESIDUE oz/ton | CALC HEAD oz/ton | GOLD EXTRN % | COMMENTS |
|---|---|---|---|---|---|
| 525 | 37 | .019 | .131 | 85 | Oxygen Roast[1] |
| 550 | 38 | .020 | .137 | 85 | Oxygen Roast[1] |
| 550 | 38 | .016 | .131 | 88 | Oxygen Roast[2] |
| 625 | 6 | .046 | .131 | 65 | Air Roast[3] |
| 675 | 6 | .044 | .137 | 68 | Air Roast[3] |
| 725 | 6 | .044 | .133 | 67 | Air Roast[4] |
| 600 | 6 | .034 | .134 | 75 | Air Roast[5] |
| 600 | 6 | .028 | .133 | 79 | Air Roast[5] |

[1]Test conducted in a six-inch circulating fluidized bed roaster with a combustion gas of air enriched to 40% oxygen by volume.
[2]Same as in footnote 1 but the test was conducted in an eight-inch circulating fluid bed roaster.
[3]Test conducted in a six-inch circulating fluid bed roaster with air as the combustion gas and the composition of the off-gas was maintained at 6% oxygen by volume.
[4]Same as in footnote 3 but the test was conducted in an eight-inch circulating fluid bed roaster.
[5]Test conducted in a six-inch stationary fluid bed roaster with air as the combustion gas and the composition of the off-gas was maintained at 6% oxygen by volume.

The foregoing examples demonstrate that the process of the present invention produces significantly desirable results from refractory ores with arsenic-, carbon- and sulfur-containing components while reducing the cost of oxygen-based roasting and minimizing arsenic volatilization.

It is noteworthy, particularly by comparing air roasting, such as those in Example 2, with oxygen-enriched air roasting, such as those in Example 1, that the present invention effectively lowers the temperature at which optimum gold recovery occurs. This is graphically demonstrated by comparing FIG. 6, which is for air roasting, with FIG. 4 which is for 40% oxygen-enriched air roasting. In FIG. 6 (air roast) the maximum gold recovery is at 600 degrees Celsius while in FIG. 4 (oxygen-enriched air roast) the maximum gold recovery is at 475 degrees Celsius. The importance of this is that the process of the present invention is more energy-economical. FIG. 5 shows that the percent gold extraction generally increases a the total oxygen content in the feed gas increases, with a practical, economical upper range based on other considerations such as operating costs, oxygen gas costs, equipment costs, etc.

EXAMPLE 7

In a schematic industrial illustration shown in FIG. 7 and described above, the following process data illustrate the application of the present invention.

The base case roaster feed analysis is as follows:

| | |
|---|---|
| Carbon Organic | 0.8% |
| Sulfide Sulfur | 2.5% |
| Weight Loss on Ignition - L.O.I. | 6.0% |
| As | 1200 ppm |

-continued

| | |
|---|---|
| Cl | 100 ppm |
| F | 1000 ppm |
| Pb | 25 ppm |
| Hg | 5 ppm |
| Sb | 80 ppm |
| Zn | 1000 ppm |
| $SiO_2$ | 80% |
| $Al_2O_3$ | 7% |

The following x-ray diffraction analysis was used to further characterize the above ore mixture:

| | |
|---|---|
| Sericite | 5% |
| Kaolinite | 11% |
| Alunite | 3% |
| Jarosite | 5% |

The ore feed had a specific gravity 2.52; and a bulk density (loose) of 1.0 m.t./$m^3$ and bulk density (packed) of 1.25 m.t./$m^3$. Roaster feed (D50) was: 50% passed at 19μ size and 80% passed at 70μ (estimate). The design roast temperature was 550° C. and the $O_2$ concentration in off-gas was 36 vol. % wet basis. Organic carbon burn-off was assumed to be 0.7% (for energy calculations).

As illustrated by the above x-ray diffraction analysis it shows the ores to contain a variety of clay compounds predominantly kaolinite but also alunite, jarosite and sericite. These compounds all have varying decomposition energies (all assumed to be endothermic). At a roasting temperature of 525°-550° C. all of the clays would be decomposed and hence all of the waters of crystallization would end up in the vapor phase.

Volatilization in roaster was taken for each elements as follows: Mercury 100%; Arsenic 1%; Fluorine 15% and Chlorine 100%.

Based on the above data, an illustration of an industrial operation as described in conjunction with FIG. 7 is shown in Table 7; this table must be read in conjunction with the description of the process in FIG. 7.

TABLE 7

PROCESS DATA FOR A CIRCULATING FLUID BED ROASTING PLANT SHOWN IN FIG. 7

| | | Stream No. | | | | | | | | | | |
|---|---|---|---|---|---|---|---|---|---|---|---|---|
| | | 200 | 201 | 202 | 203 | 204 | 205 | 206 | 207 | 208 | 209 | 210 |
| Medium | | Ore | Gas | Gas | Gas | Gas | Gas | Air | Air | Air | Calcine | Caline Slurry |
| Solids, dry | mt/h | 160 | | 38.5 | 35 | | | | | | 154 | 154 |
| | st/h | 176 | | 42 | 38 | | | | | | 170 | 170 |
| Water | mt/h | 4.1* | | 7.8 | 7.8 | 4.1 | 3.7 | | | | | 873 |
| | st/h | 4.5* | | 8.6 | 8.6 | 4.5 | 4.1 | | | | | 963 |
| Gas, wet | $m^3n/h$ | | 36100 | 47500 | 47500 | 25000 | 22500 | 1000 | 13600 | 7000 | | |
| | scfm | | 21365 | 28100 | 28100 | 14790 | 13315 | 590 | 8050 | 4140 | | |
| $SO_2$ | vol % | | 5.7 | 9.15 | 9.15 | 9.15 | 9.15 | | | | | |
| $SO_3$ | vol % | | 0.3 | 0.45 | 0.45 | 0.45 | 0.45 | 21 | | | | |
| $CO_2$ | vol % | | 6.7 | 10.8 | 10.8 | 10.8 | 10.8 | 79 | | | | |
| $O_2$ | vol % | | 56.3 | 36 | 36 | 36 | 36 | | 90 | 48 | | |
| $N_2$ | vol % | | 18.2 | 23.2 | 23.2 | 23.2 | 23.2 | | 10 | 52 | | |
| $H_2O$ | vol % | | 12.8 | 20.4 | 20.4 | 20.4 | 20.4 | | | | | |
| Temp. | °C. | 200 | 325 | 550 | 375 | 350 | 350 | 25 | 325 | 450 | 350 | ~40 |
| | °F. | 392 | 617 | 1022 | 707 | 662 | 662 | 77 | 617 | 842 | 662 | ~104 |
| Pressure | mbar | +100 | +200 | −15 | −20 | −25 | −25 | +/−0 | +200 | +75 | +/−0 | |
| | inch | +40 | +80 | −6 | −8 | −10 | −10 | | +80 | +30 | | |

*Water of crystallization in ore components
mt/h = metric tons per hour
st/h = short tons per hour
$m^3n/h$ = cubic meters normal per hour
scfm = standard cubic feet per minute For the above illustration, a carbon content in the ore was provided for at 0.8% level, but should also be provided for a range from about 0.4% to about 1.15%. However, at still lower amounts of carbon in ore, more coal or fuel needs to be added, while at higher amounts of carbon in ore less or no coal is required (autothermal conditions). Hence, about 330 kg/hr of coal calculated as carbon is added for the above ore in Table 7. Besides the heat recovered in heat recovery unit 106, the waste heat boiler 116 produces at the specified conditions about 6 tons per hour of 55 bar steam.

In the above illustration, it is noted that a total "at temperature" time for the calcine (before quenching) is about 30 minutes. Such "at temperature" time is a combined time in the CFB reactor 100 and during post-finishing in heat recovery unit 106. This "at temperature" time may range from about 25 minutes to 50 minutes and does not adversely affect the gold recovery even for the longer period; therefore, this process has an advantage because it is also free from the heat sensitivity, i.e. "at temperature" time limits such as cautioned against in some of the prior art processes and disclosures thereof.

While the above process has been illustrated as capable of treating ores of various particulate sizes, the advantageous size is determined for each ore and is typically from about -14 mesh to about -100 and less. At finer particulate sizes e.g. -100 mesh there is no need to wet grind the calcine after quenching in tank 105 but before leaching.

Although the above illustrations concerning metal recovery has been with reference to gold, other precious metal and metal recovery of arsenic containing ores may be practiced as described herein—thereby realizing the advantages of the present process, i.e. low temperature (less than 700° C.), oxygen enriched air roasting in presence of iron to immobilize arsenic as ferricarsenate in the form of scorodite or scrodite like compounds. Scorodite like compounds are intended to mean compounds of ferricarsenate with water of crystallization of varying mole amounts. For scorodite two moles of water of crystallization is typically shown but the amounts of water crystallization may vary. However, the measure for insolubility is scorodite and represents the level of insolubility which is desired. A scorodite like compound is intended to have insolubility of about the same order of magnitude as scorodite.

Moreover, while the process for gold recovery in this disclosure has been found best conducted with the indicated oxygen levels, for other metal recovery from ores which contain arsenic, such process may be practiced with even higher oxygen levels because the improvement concerning arsenic recovery as such may even be practiced with pure oxygen used as the oxidizing medium.

Because of these advantages including those derived from e.g. circulating fluidized beds, the present invention provides improvements over those shown by the prior art as previously described and pointed out with reference to that art.

While the exact reasons that cause the process of the present invention to produce the herein-observed results are unknown and could not be predicted, the results themselves bespeak the achievements that have been obtained—based merely on the percent of gold extraction and arsenic immobilization—from these refractory ores at great savings of oxygen usage and using a less complicated approach than the best prior art technology can show. It is especially noted for conditions such as apply when using a circulating fluidized bed which provides for significant heat recovery and reutilization.

It is also evident from the above that various combinations and permutations may well be practiced and advanced, but these are not to be understood as limiting the invention which has been defined in the claims which follow.

What is claimed is:

1. A process for treating ore having recoverable precious metal values and including arsenic-, carbon- and sulfur containing components which comprises:

roasting said ores in presence of iron in an amount sufficient to immobilize arsenic in a calcine but not less than about 3.5 moles of iron to one mole of arsenic, in an oxygen-enriched gaseous atmosphere having a total initial oxygen content less than about 65 percent by volume while maintaining a reaction temperature from about 475 degrees Celsius to about 600 degrees Celsius during said roasting and recovering a thus-roasted ore as calcine whereby said calcine is amenable to recovery of precious metal values in said calcine without solubilization of arsenic.

2. A process for treating ore in accordance with claim 1 in which said precious metal is gold.

3. A process for treating ore in accordance with claim 2 in which said ore is said gaseous atmosphere is being treated as fluidized solids during roasting and is of a particulate size sufficient to achieve said roasting within a fluidized bed.

4. A process for treating ore in accordance with claim 3 in which said process further comprises:

recirculating said ore in said gaseous atmosphere as fluidized solids during roasting.

5. A process for treating ore in accordance with claim 1 in which said roasting is in a single stage recirculating fluidized bed wherein said ore is maintained for a time and at a temperature sufficient to roast said ore without sintering said ore and sufficient to convert said arsenic values to a ferricarsenate and wherein said ferricarsenate is substantially insoluble in a dump of tailings.

6. A process for treating ore in accordance with claim 1 in which said process further comprises:

rendering said ore amendable to recovery of the precious metal values by leaching and substantially entirely without volatilization of the arsenic values from said ore during roasting.

7. A process for treating ore in accordance with claim 2 in which said process comprises: leaching said ore after roasting and recovering gold from it.

8. A process for treating ore in accordance with claim 7 in which prior to leaching cyanide consuming materials are removed from said ore, and thereafter said ore is leached with a carbon-in-leach or a carbon-in-pulp cyanide leachant.

9. A process for treating ore in accordance with claim 1 in which said process further comprises:

treating an ore material with chlorine or oxygen in a bath at ambient pressure or in a closed zone at ambient or elevated pressure after roasting and prior to leaching.

10. A process for treating an ore material in accordance with Claim 1 in which at least a portion of said oxygen-enriched gaseous atmosphere is recovered and augmented with additional oxygen when the final oxygen content of said atmosphere is greater than or equal to the oxygen content of air and is recirculated to a fluidized bed of said ore.

11. A process for treating ore in accordance with Claim 1 in which the oxygen content of said gaseous atmosphere and the reaction temperature are sufficient to achieve reaction of said arsenic-containing components in presence of iron in said ore without substantial volatilization of the arsenic values in said ore.

12. A process as defined by claim 1 in which the reaction temperature is from about 475 degrees Celsius to about 600 degrees Celsius.

13. A process as defined in Claim 1 in which the reaction temperature is from about 500° C. to about 550° C.

14. A process for recovery of gold values from an ore comprised of arsenic and organic and inorganic carbon values, silicates, and sulfides and clays in which gold is dispersed through said ore, said process comprising:

roasting said ore material in a single stage circulating fluidized bed in an oxygen-enriched atmosphere in which in said atmosphere the total initial oxygen content is less than about 65 percent oxygen by volume at a reaction temperature from about 475° C. degrees Celsius to about 575° C. degrees Celsius;

during said roasting, maintaining iron present in an amount sufficient to immobilize arsenic but not less than 3.5 moles of iron to one mole of arsenic and maintaining said temperature in said circulating fluidized bed, without volatilization of said arsenic in said ore as a gaseous effluent and without any substantial sintering of said silicates;

oxidizing said oxidizable values in said ore for a time sufficient to make said ore amendable to gold recovery and recovering said gold from said ore.

15. A process as defined in claim 14 in which said oxidation is aided by supplemental heat in said fluidized bed by the inclusion of a comburant.

16. A process as defined in claim 15 in which the comburant is introduced to the circulating fluidized bed.

17. The process as defined in claim 15 in which the comburant is a particulate carbonaceous comburant.

18. The process as defined in claim 15 in which the comburant is butane or propane.

19. The process as defined in claim 14 in which a retention time for said ore material in a circulating fluidized bed is at least 8 minutes.

20. The process as defined in claim 19 in which a retention a time in circulating fluidized bed is between 8 and 12 minutes.

21. In a process for recovering metal values from an ore material during roasting at a temperature of less than 700° C. in presence of oxygen in which said metal values are found in conjunction with arsenic in said ore material, the improvement comprising: maintaining in said ore material during roasting a ratio of iron to arsenic, sufficient to form under said roasting conditions a ferricarsenate but not less than about 3.5 moles of iron to one mole of arsenic.

22. The process as defined in claim 21 wherein the ratio of iron to arsenic in said ore material during said roasting is at least 4.0 moles iron to 1 mole of arsenic.

23. The process as defined in Claim 21 wherein the roasting is in presence of clays.

24. The process a defined in claim 21 wherein the ferricarsenate formed is scorodite or scorodite like compounds.

25. The process as defined in claim 21 wherein the roasting is in a fluidized bed.

26. The process as defined in claim 21 wherein the roasting is in a circulating fluid bed.

27. The process as defined in claim 21 wherein the roasting is at a temperature between 475° C. and 550° C.

28. The process as defined in claim 21 wherein the ore material is a gold containing ore material and said roasting is at a temperature between 475° C. and 600° C.

29. The process as defined in claim 28 wherein said gold containing ore material comprises sulfide-, carbon-, and arsenic containing materials and also includes clays.

30. In a process for recovery of gold values from ore materials comprising sulfide-, carbon- and arsenic containing components by roasting said ore material in presence of an oxygen containing atmosphere, the improvement comprising the steps of:

a) roasting said ore material in a circulating fluid bed roasting zone such that iron is present with said ore material in said roasting zone of at least 3.5 moles of iron to one mole of arsenic wherein said ore material is introduced in conjunction with air augmented with oxygen, wherein oxygen is between 25% and 65% by volume in said roasting zone and said air augmented with oxygen is preheated;

b) circulating said ore material in said fluid bed for a time sufficient to retain in said circulating fluid bed roasting zone said ore material to achieve substantially complete roasting reactions;

c) recovering said ore material as calcine from said circulating fluid bed roasting zone;

d) recovering heat from said calcine in at least one heat recovery zone by pre-heating said air augmented with oxygen, in intimate contact with said calcine for introduction of said thus heated air augmented with oxygen in said circulating fluid bed roasting zone;

e) recovering heat from an off-gas from said circulating fluid bed roasting zone;

f) recovering portion of said off-gas from said circulating fluid bed roasting zone for introduction of said off-gas into said circulating fluid bed roasting zone; and g) recovering gold from said calcine.

31. The process as defined in claim 30 wherein said ore material is introduced into said circulating fluid bed roasting zone after pre-heating with heated air from said heat recovery zone.

32. The process as defined in claim 30 wherein said roasting is in presence of pulverized coal, butane, or propane.

33. The process as defined in claim 30 wherein contents of said circulating fluid bed roasting zone are circulated via at least one cyclone, wherein in said cyclone said off-gas is separated and wherein underflow of said ore material from said cyclone is returned to said circulating fluid bed roasting zone for circulation therein.

34. The process as defined in claim 30 wherein heat is recovered from an off-gas in at least one heat recovery zone.

35. The process as defined in Claim 30 wherein quenching of said calcine to obtain a calcine slurry is followed by removal of cyanide consuming materials from said quench solution prior to leaching gold from said slurry.

36. The process as defined in claim 30 wherein iron is present during roasting in said ore material in an amount sufficient to form ferricarsenate with substantially all of arsenic material in said ore material.

37. The process as defined in claim 36 wherein iron is present during roasting in said material in a ratio of at least about 4.0 moles of iron to 1 mole of arsenic.

38. The process as defined in claim 30 wherein said ore material comprises water of crystallization.

39. The process as defined in claim 30 wherein said ore material comprises fluorine and said fluorine is predominately sequestered in said calcine during said roasting.

40. The process as defined in claim 30 wherein the temperature in said circulating fluid bed roasting zone is between 475° C. and 550° C.

41. The process as defined in claim 30 wherein the temperature in said fluid bed roasting zone is between 525° C. and 550° C.

42. The process as defined in claim 30 wherein a retention time of ore material in said circulating fluid bed roasting zone is between 8 to 12 minutes.

43. The process as defined in claim 30 wherein a retention time in said heat recovery zone is for a time sufficient to reduce the temperature of said calcine to about 350° C.

44. The process as defined in claim 30 wherein said heat recovery zone comprises a plurality of heat recovery units, and each successive unit has a progressively lower temperature from the unit in which said calcine is first introduced.

45. The process as defined in claim 44 wherein at least one heat recovery unit is a fluidized bed.

* * * * *